US012366438B2

(12) United States Patent
Wosch et al.

(10) Patent No.: US 12,366,438 B2
(45) Date of Patent: Jul. 22, 2025

(54) BASE PART FOR PRODUCING A CARTRIDGE CASE AND CARTRIDGE CASE, METHOD FOR PRODUCING A BASE PART FOR A CARTRIDGE CASE, AND METHOD FOR PRODUCING A CARTRIDGE CASE

(71) Applicant: Diehl Metall Stiftung & Co. KG, Röthenbach (DE)

(72) Inventors: Stefan Wosch, Röthenbach a. d. Pegnitz (DE); Marcus Singer, Lauf (DE); Murat Arbak, Lauf an der Pegnitz (DE)

(73) Assignee: Diehl Metall Stiftung & Co. KG, Röthenbach (DE)

( * ) Notice: Subject to any disclaimer, the term of this patent is extended or adjusted under 35 U.S.C. 154(b) by 34 days.

(21) Appl. No.: 18/085,638

(22) Filed: Dec. 21, 2022

(65) Prior Publication Data

US 2023/0124564 A1 Apr. 20, 2023

Related U.S. Application Data

(63) Continuation of application No. PCT/EP2021/065502, filed on Jun. 9, 2021.

(30) Foreign Application Priority Data

Jun. 23, 2020 (DE) ..... 10 2020 003 744.5

(51) Int. Cl.

| | |
|---|---|
| ***F42C 19/08*** | (2006.01) |
| ***B21K 21/04*** | (2006.01) |
| ***F42B 5/28*** | (2006.01) |

(52) U.S. Cl.
CPC ..... *F42C 19/083* (2013.01); *B21K 21/04* (2013.01); *F42B 5/28* (2013.01)

(58) Field of Classification Search
CPC ..... F42B 5/00; F42B 5/02; F42B 5/26; F42B 5/28; F42B 5/285; F42B 5/30;
(Continued)

(56) References Cited

U.S. PATENT DOCUMENTS 683,384 A * 9/1901 Cole ..... F42B 5/02 102/436
1,659,625 A * 2/1928 Cowan ..... F42B 5/02 42/78

(Continued)

FOREIGN PATENT DOCUMENTS

DE 700207 C 12/1940
DE 719783 C 4/1942

(Continued)

OTHER PUBLICATIONS

Writtern Opinion of the International Searching Authority for PCT/EP2021/065502 (Year: 2021).*

*Primary Examiner* — James S Bergin
(74) *Attorney, Agent, or Firm* — Laurence A. Greenberg; Werner H. Stemer; Ralph E. Locher

(57) ABSTRACT

A base part intended for producing a cartridge case has a case base for receiving a primer, wherein a peripheral extractor recess is provided on the outer circumference of the base part. To simplify production, the extractor recess has a polygonal geometry that is formed in cross section by a closed traverse.

44 Claims, 13 Drawing Sheets

(58) Field of Classification Search
CPC .. F42B 5/307; F42B 5/313; F42B 5/32; F42B 5/34; F42B 5/36; F42B 33/00; F42B 33/001; F42C 19/08; F42C 19/083; F42C 19/0823; F42C 19/0807; F42C 19/10; B21K 21/04
USPC ..... 102/464–472
See application file for complete search history.

(56) References Cited

U.S. PATENT DOCUMENTS

| | | | | |
|---|---|---|---|---|
| 2,904,873 | A | 9/1959 | Hild | |
| 3,736,693 | A * | 6/1973 | Koch | F41A 21/12 42/76.01 |
| 3,896,732 | A * | 7/1975 | Schaffer | F42B 5/02 89/14.05 |
| 9,016,184 | B2 | 4/2015 | Hay et al. | |
| 10,041,770 | B2 | 8/2018 | Burrow | |
| 10,495,430 | B2 | 12/2019 | Carper et al. | |
| 2005/0150413 | A1 * | 7/2005 | Lord | F42B 5/26 102/436 |

FOREIGN PATENT DOCUMENTS

| | | | |
|---|---|---|---|
| DE | 1732984 | C | 3/1943 |
| EP | 2690391 | A1 | 1/2014 |
| EP | 2918962 | A1 | 6/2015 |
| EP | 3372324 | A1 | 9/2018 |
| WO | 2014051940 | A1 | 4/2014 |

* cited by examiner

BASE PART FOR PRODUCING A CARTRIDGE CASE AND CARTRIDGE CASE, METHOD FOR PRODUCING A BASE PART FOR A CARTRIDGE CASE, AND METHOD FOR PRODUCING A CARTRIDGE CASE

CROSS-REFERENCE TO RELATED APPLICATION

This application is a continuation, under 35 U.S.C. § 120, of copending International Patent Application PCT/EP2021/065502, filed Jun. 9, 2021, which designated the United States; this application also claims the priority, under 35 U.S.C. § 119, of German Patent Application DE 10 2020 003 744.5, filed Jun. 23, 2020; the prior applications are herewith incorporated by reference in their entirety.

FIELD AND BACKGROUND OF THE INVENTION

The invention relates to a base part for producing a cartridge case, the base part having a case base for receiving a primer cap, wherein a circumferential extractor recess is provided on the outer circumference of the base part. The invention further relates to a cartridge case having a cylindrical case which has a case opening for receiving a propellant charge and a projectile, and also has a base part opposite the case opening. In addition, the invention relates to a method for producing the base part and the cartridge case.

European patent EP 2 690 391 A1 discloses a method for producing a cartridge case. In the case of the method known in the art, an extraction groove in the form of a circumferential rotational surface is produced in a casing blank by reshaping the blank. In order to produce the extraction groove, a relatively complex reshaping tool is required, which contains a place marker among other things. The place marker in turn has 6 to 8 segments.

International patent disclosure WO 2014/051940 A1, corresponding to U.S. Pat. No. 9,016,184, and published European patent application EP 3 372 324 A1, corresponding to U.S. Pat. No. 10,495,430, disclose a method for producing a casing blank configured in one piece. The extraction groove in the form of a circumferential rotational surface is produced in the casing blank by means of a machining method. The production of a extraction groove by machining is complex.

U.S. patent Ser. No. 10/041,770 B2 discloses the production of a cartridge case with a two-part design. In order to produce a two-part cartridge case of this kind, a base part provided with a circumferential extraction groove is connected to a case. The production of two-part cartridge cases is also complex.

SUMMARY OF THE INVENTION

The problem addressed by the invention is that of eliminating the disadvantages of the prior art. In particular, a base part for producing a cartridge case and a cartridge case which can easily be produced should be specified. In addition, methods for producing a base part and/or a cartridge case which can be carried out as simply and cost-effectively as possible are specified.

This problem is solved by the features of the independent patent claims. Practical embodiments of the invention result from the features of the dependent patent claims.

In accordance with the invention, in the case of a base part for producing a cartridge case, it is proposed that the extractor recess has a polygon geometry which is formed from a closed traverse in cross section. In the case of traditional base parts, the extractor recess is configured as a groove and therefore as a circumferential rotational surface which forms a circle in cross section. The proposed polygonal shape of the extractor recess can be produced in a simplified manner, in particular by means of reshaping methods. During reshaping, material can flow from the middle of each path of the traverse towards the corners bordering the paths in cross section. Surprisingly, it has emerged that the functions of a traditional extraction groove are also satisfied by an extractor recess which has the geometry of a polygon.

A "base part" within the meaning of the present invention is normally a body with a cylindrical design, at least sectionally. The term "cross section" refers to a sectional plane which intersects the cylindrical axis perpendicularly and runs through the extractor recess. The term "extractor recess" refers to a depression extending radially inwardly from the outer circumference of the base part or a base section. The extractor recess may be produced, in that it is pressed in from the outer circumference by a radially inwardly acting force. In addition, it is also possible for the extractor recess to be produced by means of machining methods. Finally, it is also conceivable, starting from a profiled base body, for cylindrical portions to be formed on both sides of a profile section by radially outwardly acting forces, so that the extractor recess results.

According to an advantageous embodiment, at least some of the paths forming the traverse are straight. All paths are preferably straight. However, it may also be the case that at least some of the paths forming the traverse are curved (e.g. convex or concave). The paths are usually delimited by corners in the traverse. The corners may also be rounded.

According to an advantageous embodiment, the traverse is rotationally symmetrical in relation to an axis of rotation. The traverse may, in particular, have 2n-fold rotational symmetry in relation to an axis of rotation, where n is a number≥3. In other words, the polygon geometry may be configured as a regular hexagon, octagon, etc.

According to a further embodiment, the case base has an opening for receiving the primer cap.

A base part having the aforementioned features may be configured in such a manner that it is suitable as an assembly part for producing a cartridge case. However, it may also be configured in such a manner that the cartridge case can be produced in part by means of a further forming method.

According to a further aspect of the invention, a cartridge case with a cylindrical case is proposed, which has a case opening for receiving a propellant charge and a projectile, and also a base part according to the invention opposite the case opening.

The cylindrical case and the base part may have an integral design. However, it may also be the case that the cylindrical case and the base part are fixedly connected by means of joining technology. The base part may be welded to the case, for example.

According to a further aspect of the invention, a method for producing a cartridge case is proposed, having a cylindrical case which has a case opening for receiving a propellant charge and a projectile, and also a base part opposite the case opening with a case base for receiving a primer cap. The method including the following steps of:

supplying a base body for producing the cartridge case, and producing a circumferential extractor recess on the outer circumference of the base body in the form of a polygon geometry which forms a closed traverse in cross section.

The proposed method supplies an integral cartridge case. The base body may have a cylindrical case even prior to the production of the circumferential extractor recess. However, it may also be the case that the cylindrical case is formed only following production of the extractor recess.

According to a further aspect of the invention, a method is proposed for the production of a base part for a cartridge case, which base part has a casing base for receiving a primer cap. The method contains the following steps of:

supplying a base body, and producing a circumferential extractor recess on the outer circumference of the base body in the form of a polygon geometry which forms a closed traverse in cross section.

The proposed method variant supplies a base part which is particularly suitable for the production of multi-part cartridge cases, in which the base part is joined to a case.

Within the meaning of the present invention, the term "base body" should be understood to have a general meaning. It is a metal body which may be a wire section with a cylindrical outer circumference, for example. However, the base body may also be a preform part which has already been reshaped or processed by means of machining methods. The base body may already have an opening for receiving the primer cap.

According to an advantageous embodiment, the polygon geometry starting from a cylindrical base body is produced by means of a reshaping method or a machining method. The polygon geometry can easily be produced by means of a reshaping method, in particular. A hardening of the formed zones, especially at the base section, may well be desirable.

The polygon geometry is advantageously stamped in an outer circumference of the base body. It has proved particularly advantageous for the polygon geometry to be produced by means of multiple shaping steps.

Advantageously, in a first shaping step, a first polygon geometry is stamped into the outer circumference of the base body and in a second shaping step, a second polygon geometry sectionally overlaying the first polygon geometry is stamped into the first polygon geometry.

According to the proposed embodiment, in a first shaping step, a first polygon geometry is stamped into the outer circumference of the base blank. This can be done using a relatively simply formed shaping die. In a second shaping step following the first shaping step, a second polygon geometry that overlaps the first polygon geometry at least sectionally is stamped into the first polygon geometry. The second shaping step can also be carried out using a simply formed shaping die. By over-stamping the first polygon geometry, at least sectionally, in the second shaping step, an extractor recess configured as a polygon is obtained with a high degree of dimensional accuracy. As a result of the second shaping step, the number of paths or polygon paths is advantageously increased by the second shaping step compared with the first shaping step. For example, the first polygon geometry may have 6-fold rotational symmetry in relation to an axis of rotation. The second polygon geometry may have 12-fold or 24-fold rotational symmetric in relation to an axis of rotation.

According to an advantageous embodiment, first edges produced in the first shaping step are at least partially over-stamped in the second shaping step. Particularly in the closing region of the shaping dies, first edges may exhibit a burr, or the like, following the first shaping step. Since first edges produced during the first shaping step are at least partially over-stamped in the second shaping step, a polygonal shaped extractor recess can be produced in a simple and cost-effective manner with a high degree of geometric precision.

A 2-part or multi-part shaping die is advantageously used to produce the polygon geometries. A simply configured 2-, 3- or 4-part shaping die is generally sufficient. Multi-part shaping dies, e.g. 8-, 9- or 10-part shaping dies, can also be used.

According to a further embodiment of the method, the base body can be rotated axially by a predetermined angle relative to the shaping die following the first shaping step and before the second shaping step. In other words, either the base body can be rotated relative to the fixed shaping die or the shaping die can be rotated relative to the fixed base body. It is also possible for the base body to be placed in a second shaping die following the first shaping step, the shaping die being rotated by a predetermined angle with respect to the polygon geometry relative to the polygon geometry provided in the first shaping die. As a result, the edges of the second polygon geometry lie at least partially on the paths of the first polygon geometry.

It is possible for the first and the second polygon geometry to be produced using the same shaping die. In other words, two identical shaping dies can be used one after the other along a forming path to produce the first and second polygon geometry. When a first base body provided with the first polygon geometry is realized, the base body is advantageously rotated by a predetermined angle and then placed in the next shaping die, in order to produce the second polygon geometry.

According to an advantageous embodiment, the first polygon geometry is produced by means of a first shaping die and the second polygon geometry by means of a second shaping die which is different from the first shaping die. For example, a first polygon geometry with 6-fold rotational symmetry in relation to an axis of rotation can be produced using the first shaping die. A second polygon geometry can be produced using the second shaping die, which has 12-fold rotational symmetry in relation to an axis of rotation, for example. The first polygon geometry may be over-stamped by the second polygon geometry, in such a manner that the first edges of the first polygon geometry coincide with second edges of the second polygon geometry. However, it may also be the case that the first edges of the first polygon geometry do not coincide with the second edges of the subsequently produced second polygon geometry.

According to an advantageous embodiment, at least one tool can be inserted into the base body and/or applied to the outer circumference of the base body during the shaping method. By means of the tool, holding, indexing, perforating, filling, stamping and/or shaping can be applied to the base body. In this way, the dimensional accuracy during production of the base part can be improved.

According to an alternative embodiment, the base part or the cartridge case can also be produced from a further base body having the polygon geometry by means of a shaping method. In other words, in this case the polygon geometry of the extractor recess is predetermined by the further base body. The further base body is shaped in such a manner that a cylindrical outer circumference is formed, in which the extractor recess with the polygon geometry remains. Furthermore, it is also conceivable for the polygon geometry to be produced starting from a cylindrical base body by means of rolling.

The opening for receiving the primer cap can be produced before, during or after the polygon geometry is produced in the case base.

The polygon geometry advantageously has a 2n-fold rotational symmetry in relation to an axis of rotation, wherein n is a number≥3. In other words, the polygon geometry of the extractor recess may have a 6-, 8-, 10-, 12-fold rotational geometry about an axis of rotation, for example.

According to a further aspect of the invention, a method for producing a cartridge case is proposed, having a cylindrical case which contains a case opening for receiving a propellant charge and a projectile, and also a base part opposite the case opening having a case bottom for receiving a primer cap. The method includes the following steps of:

supplying a base part produced according to the method described above, and preforming the cylindrical case at the base part by means of extrusion.

The proposed method provides a cartridge case, in which the base part and the case are formed from one piece.

The forming of the cylindrical case may also advantageously take place by means of extrusion and deep-drawing.

Prior to the forming of the case, at least one tool can be inserted into the base part and/or applied to the outer circumference of the base part. By means of the tool, holding, indexing, perforating, filling, stamping and/or forming can be applied to the base part and/or the case.

A cartridge case produced according to the above method can be produced solely by means of shaping and therefore produced particularly efficiently.

Furthermore, a method for producing a cartridge case is proposed, having a cylindrical case which has a case opening for receiving a propellant charge and a projectile, and also a base part opposite the case opening with a case base for receiving a primer cap. The method includes the following steps of:

supplying a base part produced according to the method described above, supplying the case, and connecting the base part to the case by means of a joining method.

The joining method may, for example, be a welding method or other suitable methods.

It is stressed that the sequence of method steps in the methods listed in the description and in the claims is not limited to the order shown in each case and any other sequences of steps are also included.

The base body and/or the case is/are advantageously produced from a non-ferrous metal or steel. The non-ferrous metal may be selected from the following group: brass, aluminum or aluminum alloy.

Other features which are considered as characteristic for the invention are set forth in the appended claims.

Although the invention is illustrated and described herein as embodied in a base part for producing a cartridge case and a cartridge case, a method for producing a base part for a cartridge case, and a method for producing a cartridge case, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The invention is explained below with the help of a base body for producing a cartridge case. Instead of the base body for producing a cartridge case, a base body for producing the base part can also be supplied and the base part can be produced from this using an analogous method. A base part of this kind can be joined to a case to create a cartridge case.

Figure 1:
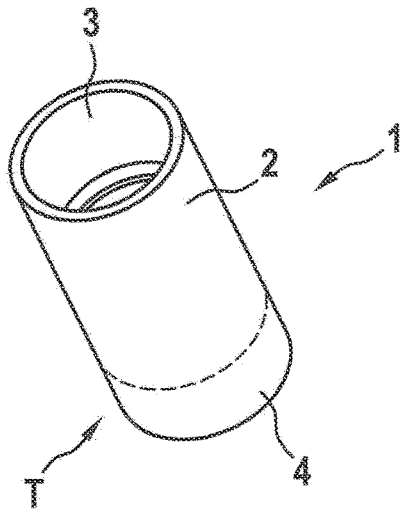
FIG. 1 is a diagrammatic, perspective view of a base body.
Figure 2:
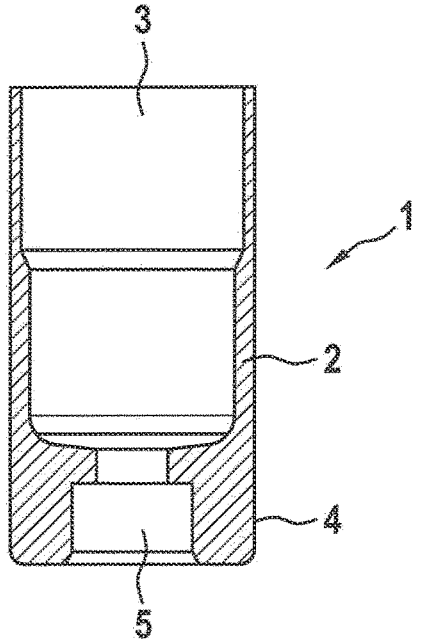
FIG. 2 is a sectional view according to FIG. 1.
Figure 3:
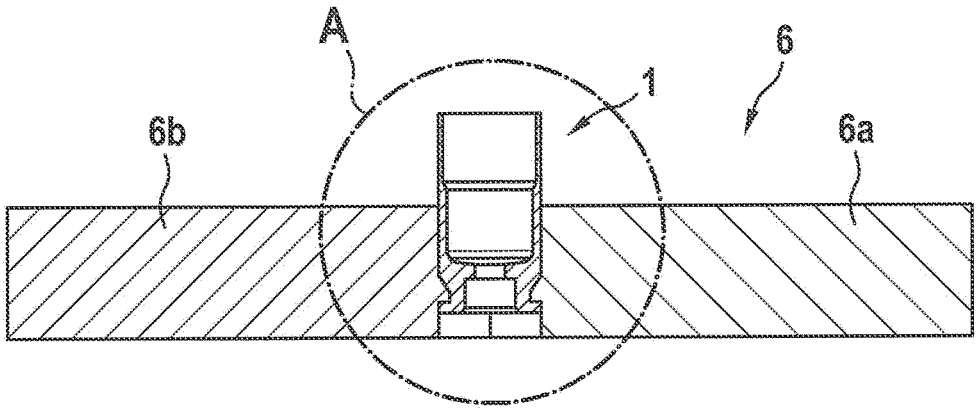
FIG. 3 is a first sectional view through a first shaping die.
Figure 4:
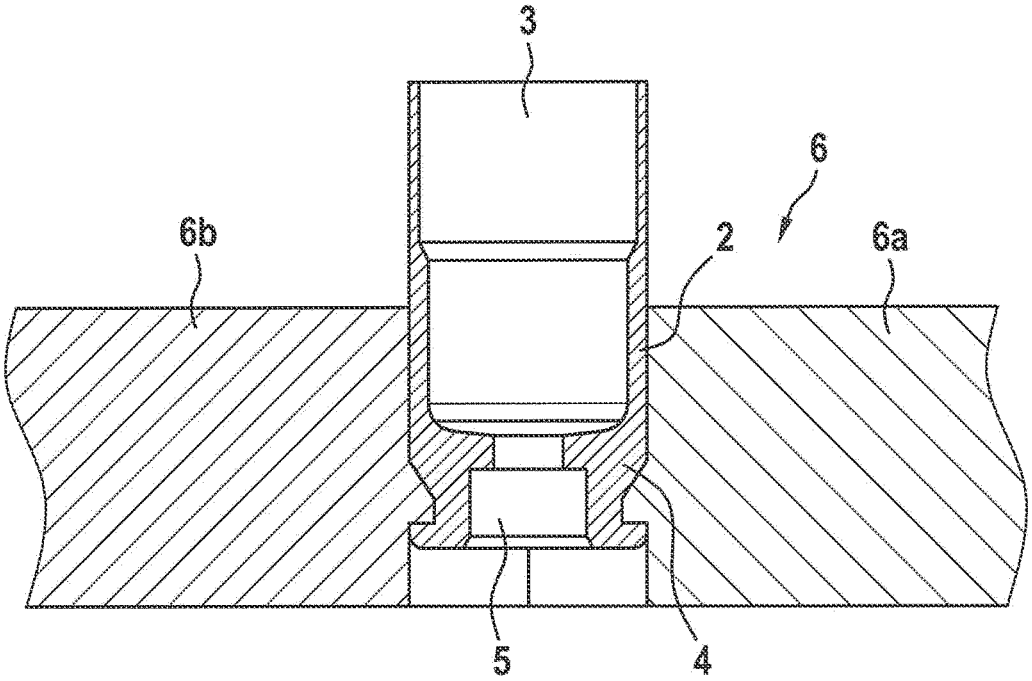
FIG. 4 is an enlarged view according to FIG. 3.
Figure 5:
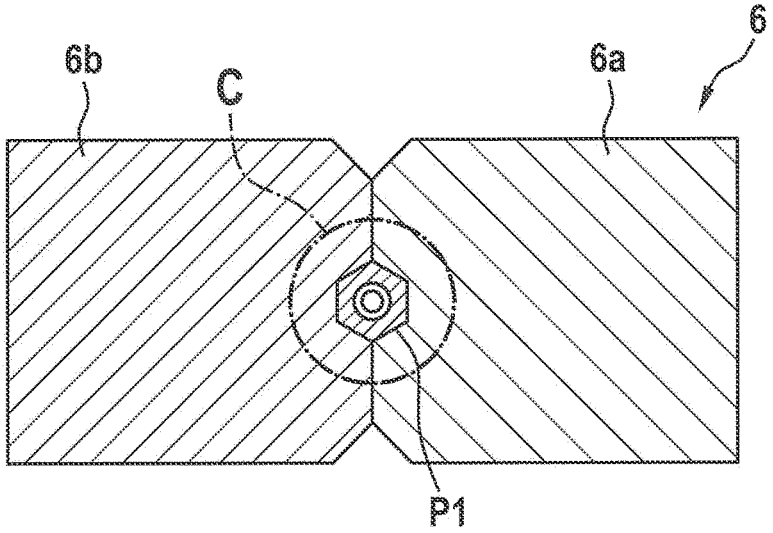
FIG. 5 is a second sectional view of the first shaping die according to FIG. 3.
Figure 6:
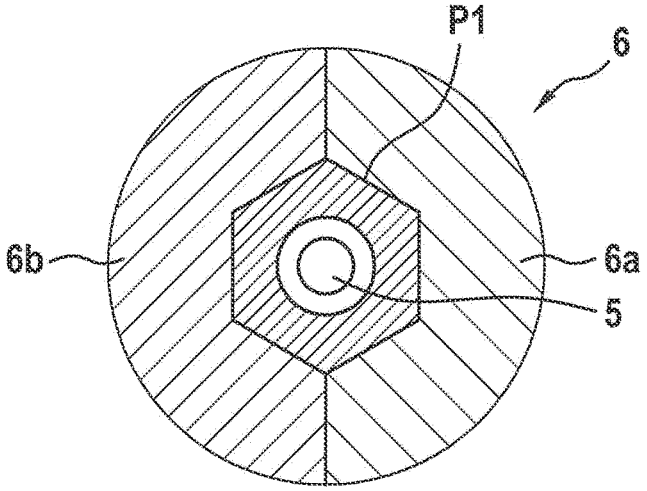
FIG. 6 is an enlarged sectional view according to FIG. 5.

Referring now to the figures of the drawings in detail and first, particularly to FIG. 1 thereof, there is shown a perspective view of a base body 1 for producing a cartridge case which is produced in one piece, e.g. by means of extrusion or extrusion and deep drawing. The base body 1 has a cylindrical case 2 which has a case opening 3 and a case base 4 opposite the case opening 3. The case base 4 has an opening 5 for receiving a primer cap (not shown here). A base part is indicated by the dotted line. The base part may be formed from a separate base part T in the case of a multipart embodiment of the cartridge case.

FIGS. 3 to 6 and 21 to 23 show the production of a first polygon geometry P1 in the region of the case base 4. A first shaping die 6 is made up of two first die halves 6*a*, 6*b* in this case. As can be seen from FIGS. 5, 6, 21 and 23, in particular, the first shaping die 6 has a relatively simple design. It has first projections 7 (see FIG. 23) in the region of its first die cavity K1 for stamping a first polygon geometry P1 into the case base 4. The first polygon geometry P1 is a 6-fold rotationally symmetrical polygon geometry in relation to an axis of rotation. A polygon geometry, as shown in cross section in FIGS. 5 and 6, for example, is formed by a closed traverse. The paths are delimited by corners. The paths are straight in this case.

Figure 7:
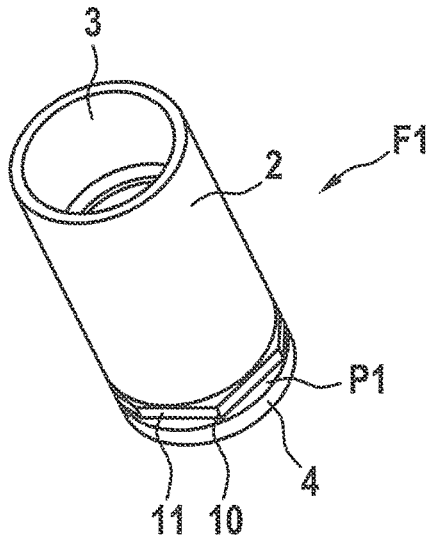
FIG. 7 is a perspective view of a first case forming body.
Figure 8:
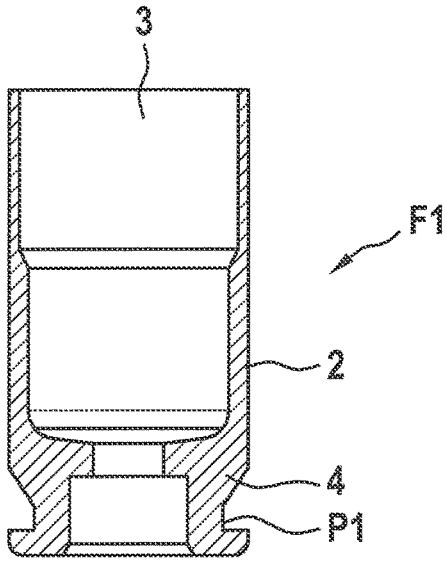
FIG. 8 is a sectional view according to FIG. 7.
Figure 9:
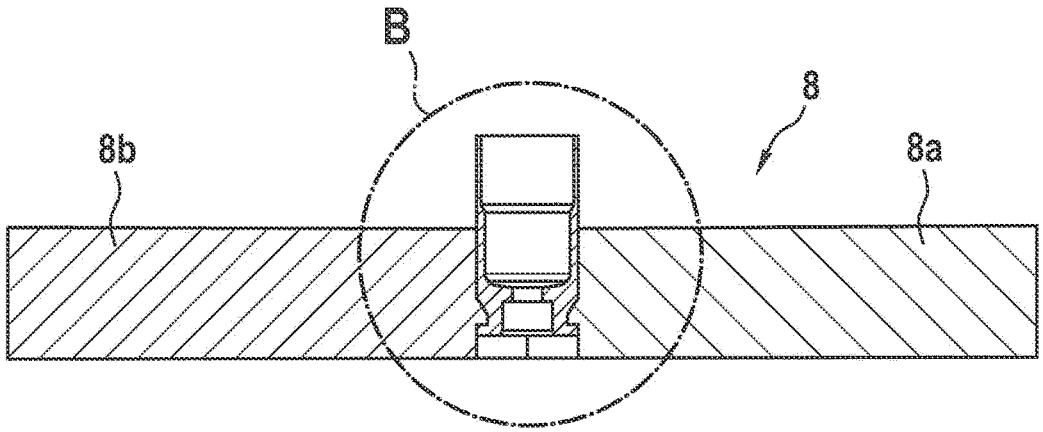
FIG. 9 is a sectional view through a second shaping die.
Figure 13:
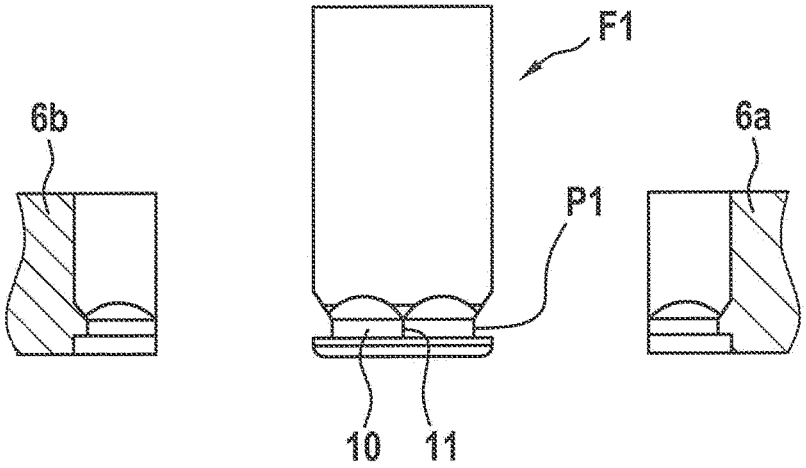
FIG. 13 is a side view of the first case forming body according to FIG. 7 with the first shaping die open.

FIGS. 7, 8 and 13 show a first case forming body F1, i.e. the base body according to the first shaping step. The first polygon geometry P1 stamped into the case base 4 has first polygon faces 10 which are delimited in the circumferential direction by first edges 11 in each case.

FIGS. 9 to 12 and 24 to 26 show the production of a second polygon geometry P2 in a second shaping step. In order to produce the second polygon geometry P2, the first case forming body F1 is inserted into a second shaping die 8 which may be formed from two second die halves 8*a*, 8*b* in a similar way to the first shaping die 6. As can be seen from FIGS. 9 to 12 and 24 to 26, the second shaping die 8 has a second die cavity K2 with second projections 9 (see FIG. 26), which has 6-fold rotational symmetry in relation to an axis of rotation, in order to produce the second polygon geometry P2. The second projections 9 are rotated by approximately 30 degrees in relation to the first projections 7. The first case forming body F1 is inserted into the second shaping die 8 in such a way that first edges 11 of the first polygon geometry P1 are located roughly in the middle of a straight portion of the second projections 9. Consequently, when the second shaping die 8 is closed, the first polygon geometry P1 is over-stamped with a second polygon geometry P2 (see FIG. 12). A second case forming body F2 with a second polygon geometry P2 which has 12-fold rotational symmetry results (see FIGS. 16 to 19). The second polygon geometry P2 has second polygon faces 12 which are delimited in the circumferential direction by second edges 13 (see FIG. 14).

Figure 10:
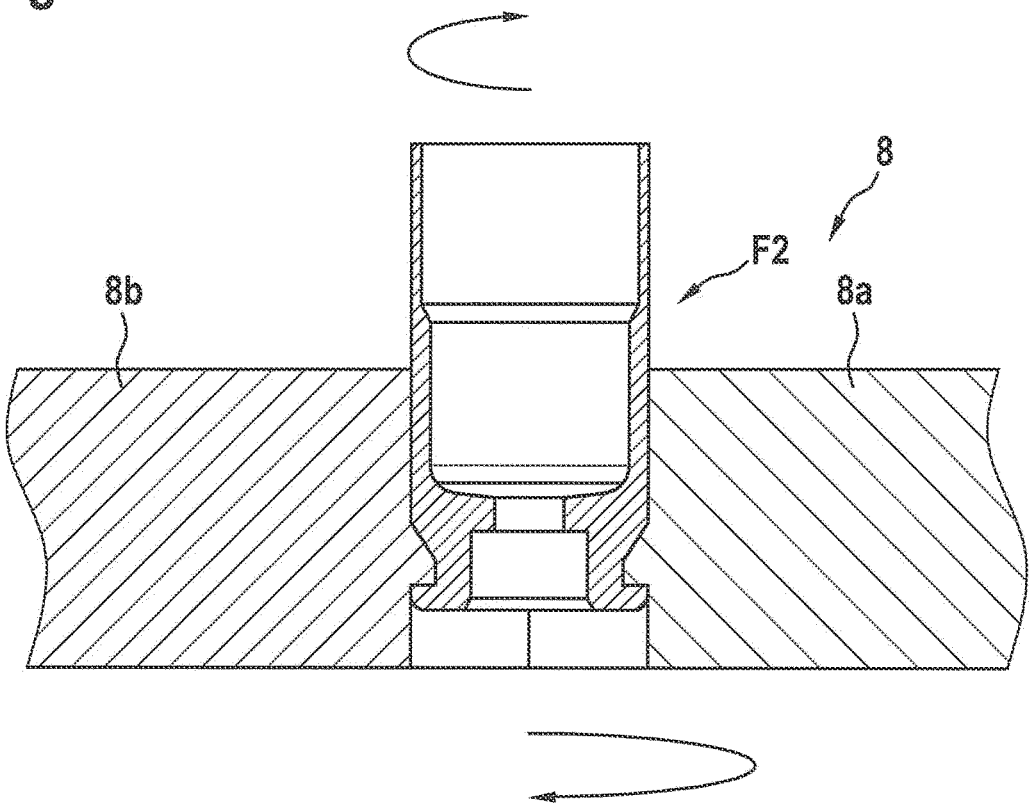
FIG. 10 is an enlarged view according to FIG. 9.
Figure 11:
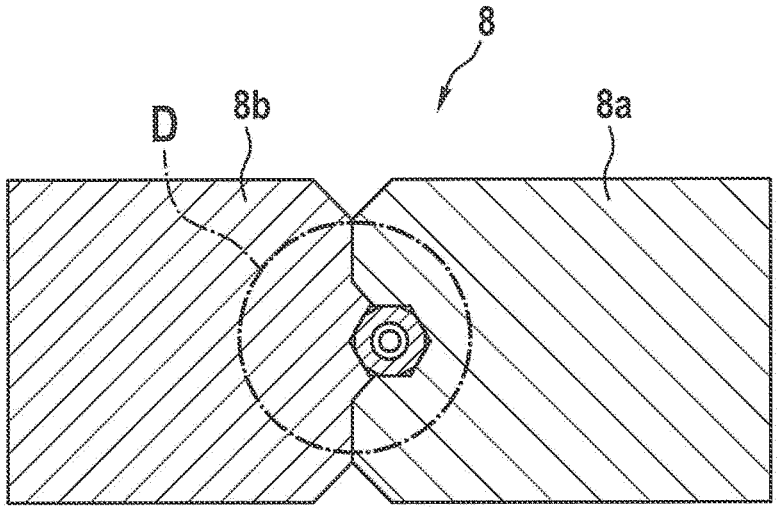
FIG. 11 is a second sectional view through the second shaping die.
Figure 12:
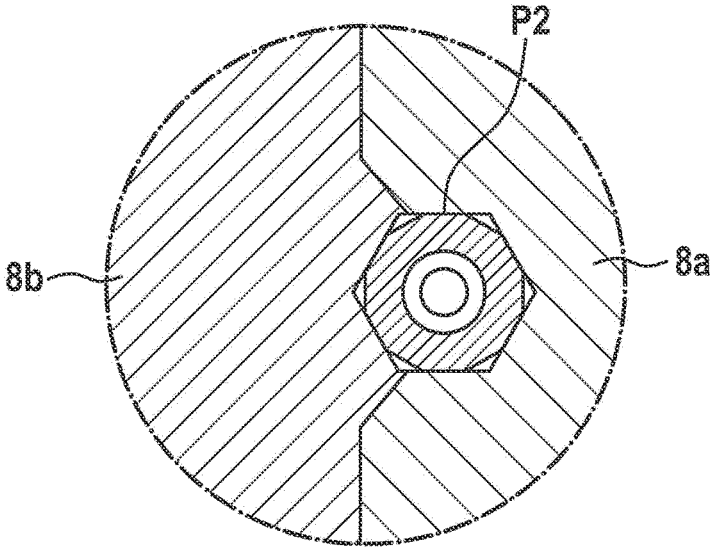
FIG. 12 is an enlarged sectional view according to FIG. 11.

As indicated by the arrows in FIG. 10, further shaping steps can take place in order to produce a polygon geometry. For this purpose, for example, the second case forming body F2 can be rotated by a predetermined angular amount relative to the second shaping die 8 and subsequently shaped in a third shaping step. In a similar manner, further shaping steps can be carried out.

Figure 14:
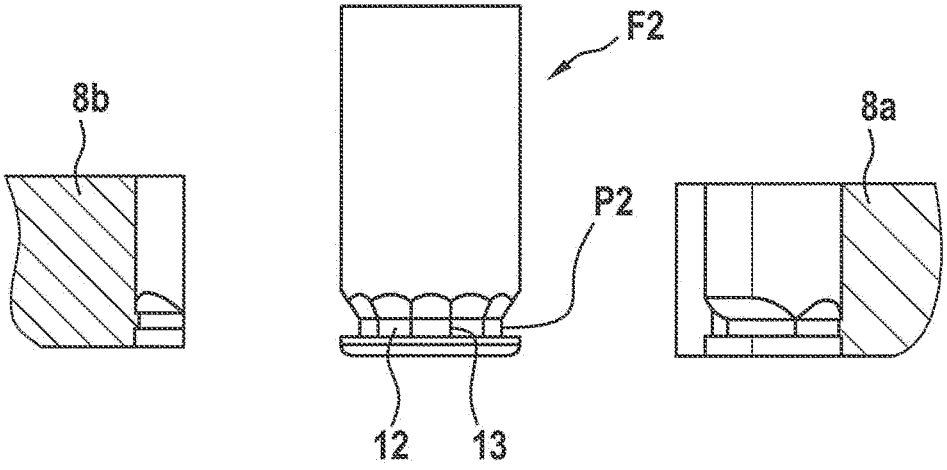
FIG. 14 is a side view of a second case forming body with the second shaping die open.
Figure 15:
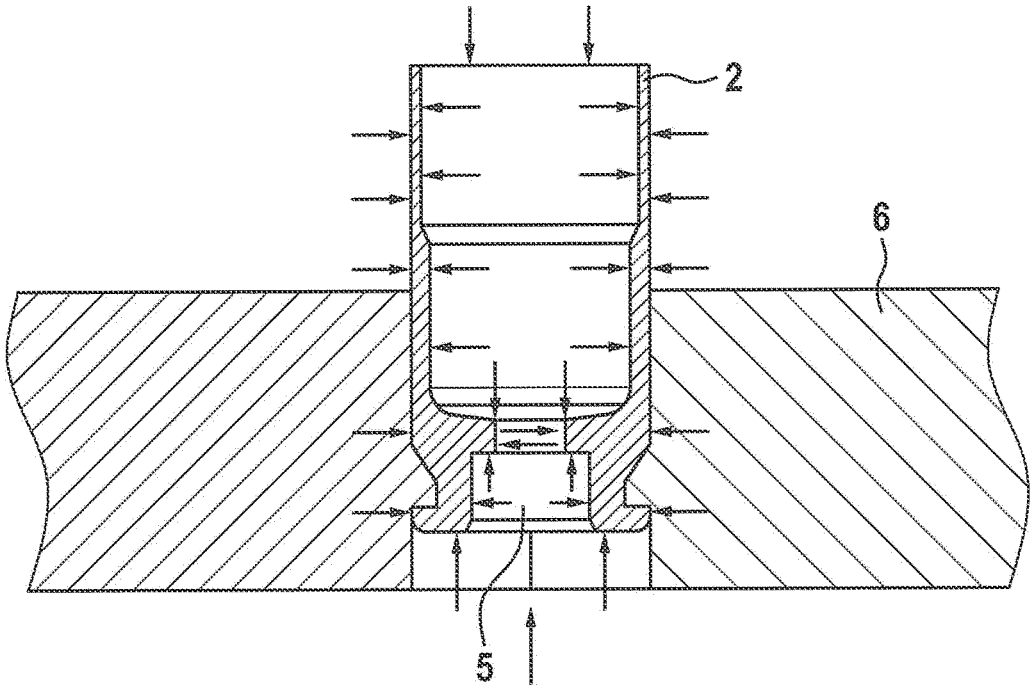
FIG. 15 is a sectional view through a shaping die with the case forming body received therein.
Figure 16:
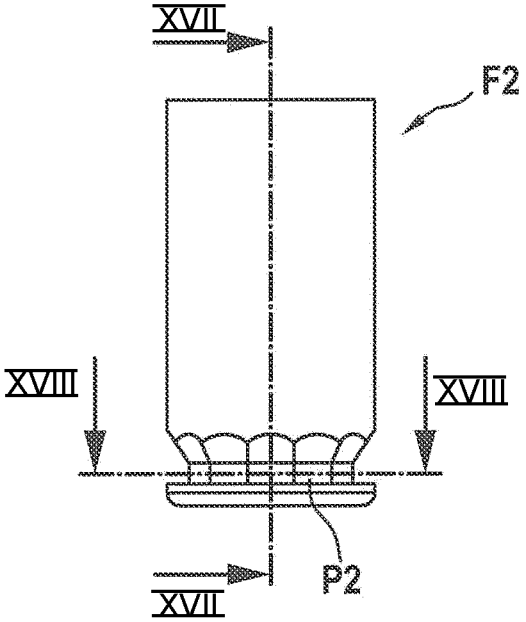
FIG. 16 is a side view of a second case forming body.
Figure 17:
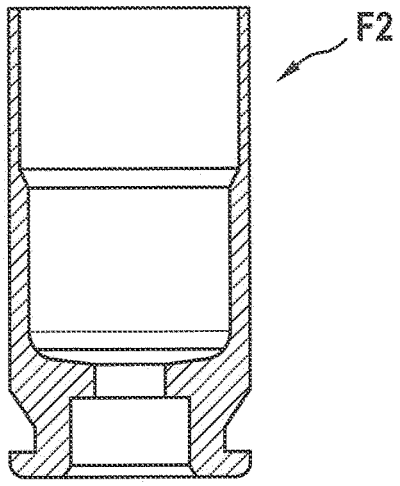
FIG. 17 is a sectional view according to the cutting line XVII-XVII shown in FIG. 16.
Figure 18:
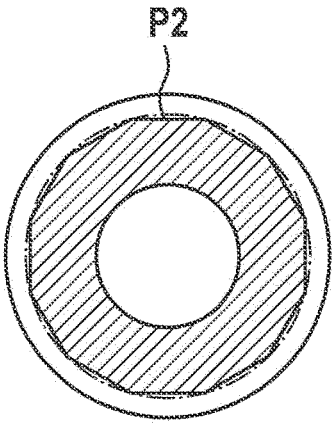
FIG. 18 is a cross-sectional view according to the cutting line XVIII-XVIII in FIG. 16.
Figure 19:
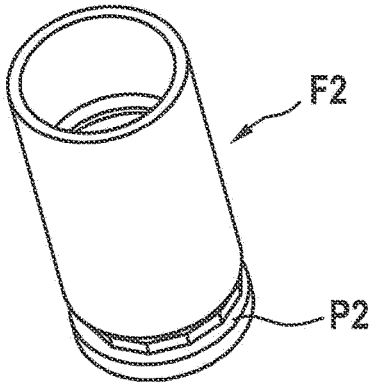
FIG. 19 is a perspective view according to FIG. 16.

FIG. 13 shows the first case forming body F1 with the first shaping die 6 open. FIG. 14 shows, in a similar manner, the second case forming body F2 with the second shaping die 8 open. As can be seen from FIG. 15 in particular, a tool (not shown here) can be introduced into the case 2 and/or the opening 5 during the stamping of the first polygon geometry P1 and/or second polygon geometry P2. A tool (not shown here) can also be applied to the outer circumference of the base body or of the case forming body. In this way, an unwanted reshaping, in particular a folding or the like, within the case 2 and/or the opening 5 can be avoided. The arrows indicate that the tool can act in a holding, filling, stamping or shaping manner. Apart from this, it is also conceivable for the tool to have a perforating or indexing effect.

Figure 20:
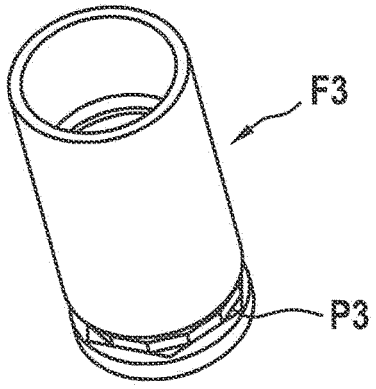
FIG. 20 is a perspective view of a third case forming body.
Figure 21:
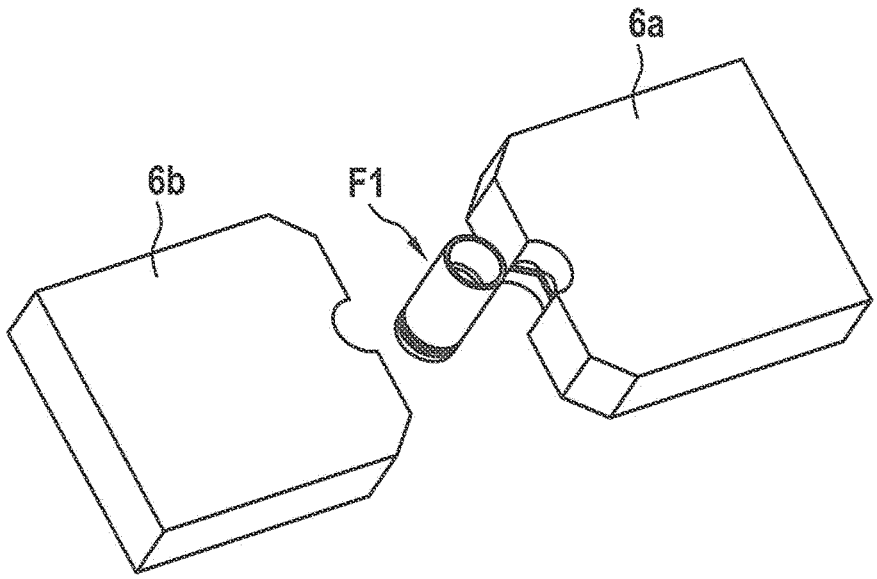
FIG. 21 is a perspective view of a first shaping die in the open state and of a first case forming body.
Figure 22:
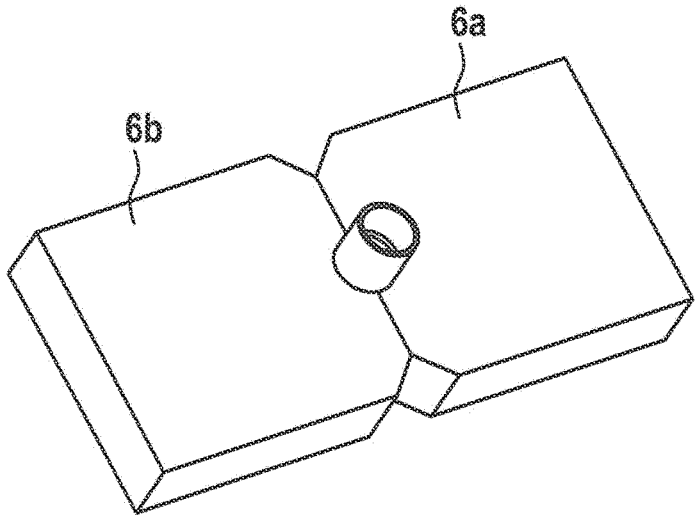
FIG. 22 is a perspective view according to FIG. 21, wherein the first shaping die is closed.
Figure 23:
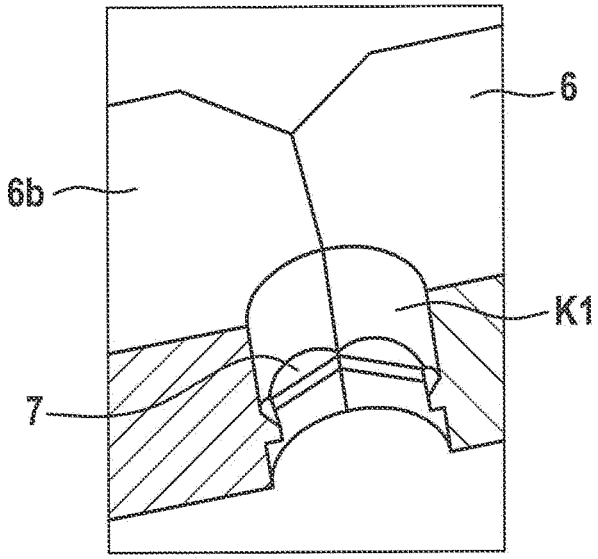
FIG. 23 is a perspective view of a first cavity of the first shaping die.
Figure 24:
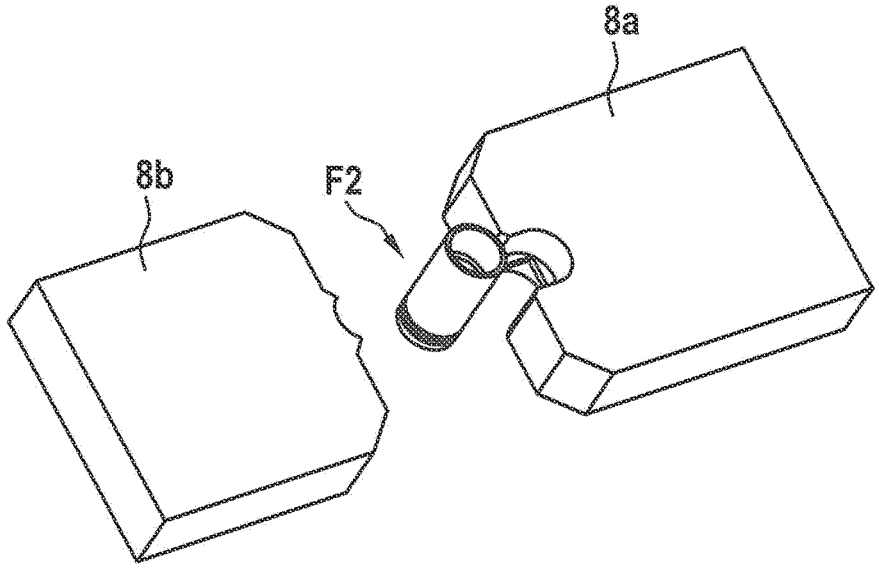
FIG. 24 is a perspective view of a second shaping die in the open state and a second case forming body.
Figure 25:
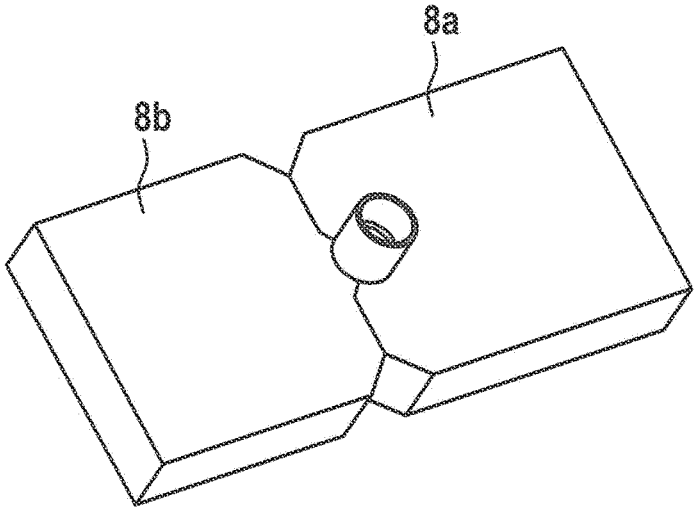
FIG. 25 is a perspective view of the second shaping die in the closed state.
Figure 26:
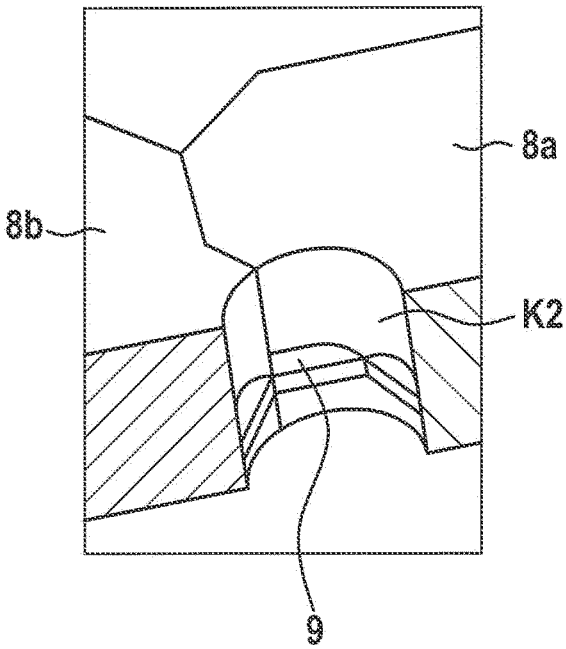
FIG. 26 is a perspective, sectional view of a second cavity of the second shaping die in the closed state.

FIG. 20 shows a third case forming body F3 which has a third polygon geometry P3. The third polygon geometry P3 may be produced, for example, in that the first polygon geometry P1 is over-stamped with a second polygon geometry P2, which does not coincide with the first polygon geometry P1 and, moreover, is offset by a predetermined angle relative to the first polygon geometry P1.

The following is a summary list of reference numerals and the corresponding structure used in the above description of the invention.

LIST OF REFERENCE SIGNS

1 base body
2 case
3 case opening
4 case base
5 opening
6 first shaping die
6*a*, 6*b* first die halves
7 first projections
8 second shaping die
8*a*, 8*b* second die halves
9 second projections
10 first polygon face
11 first edge
12 second polygon face
13 second edge
T base part
P1 first polygon geometry
P2 second polygon geometry
P3 third polygon geometry
F1 first case forming body
F2 second case forming body
F3 third case forming body
K1 first die cavity
K2 second die cavity

The invention claimed is:

1. A base part for producing a cartridge case, the base part comprising:

a case base for receiving a primer cap, said case base having a circumferential extractor recess formed therein on an outer circumference of the base part, said circumferential extractor recess having a polygon geometry being formed from a closed traverse in cross section, said case base having a cylindrical portion adjacent said circumferential extractor recess.

2. The base part according to claim 1, wherein at least some paths forming the closed traverse are straight.

3. The base part according to claim 1, wherein at least some paths forming the closed traverse are curved.

4. The base part according to claim 1, wherein the closed traverse is rotationally symmetrical in relation to an axis of rotation.

5. The base part according to claim 1, wherein the closed traverse has a 2n-fold rotational symmetry in relation to an axis of rotation, where n is a number≥3.

6. The base part according to claim 1, wherein said case base has an opening formed therein for receiving the primer cap.

7. A cartridge case, comprising:

a cylindrical case having a case opening formed therein for receiving a propellant charge and a projectile; and said base part according to claim 1, said base part disposed opposite said case opening.

8. The cartridge case according to claim 7, wherein said cylindrical case and said base part are formed in one piece.

9. The cartridge case according to claim 7, wherein said cylindrical case and said base part are fixedly connected by means of joining technology.

10. A method for producing a cartridge case having a cylindrical case with a case opening formed therein for receiving a propellant charge and a projectile, and also a base part opposite the case opening with a case base for receiving a primer cap, the method comprises the following steps of:

supplying a base body for producing the cartridge case;

producing a circumferential extractor recess on an outer circumference of the base body in a form of a polygon geometry forming a closed traverse in cross section.

11. The method according to claim 10, wherein the polygon geometry starting from the base body being cylindrical is produced by a reshaping method and/or a machining method.

12. The method according to claim 11, which further comprises stamping the polygon geometry into the outer circumference of the base body.

13. The method according to claim 11, which further comprises producing the polygon geometry by means of a plurality of shaping steps.

14. The method according to claim 13, wherein:

in a first shaping step, stamping a first polygon geometry into the outer circumference of the base body; and in a second shaping step, stamping a second polygon geometry sectionally overlaying the first polygon geometry into the first polygon geometry.

15. The method according to claim 14, wherein first edges produced in the first shaping step are at least partially over-stamped in the second shaping step.

16. The method according to claim 14, wherein the base body can be rotated axially by a predetermined angle relative to a shaping die following the first shaping step and before the second shaping step.

17. The method according to claim 14, which further comprises producing the first polygon geometry by means of a first shaping die and the second polygon geometry by means of a second shaping die which is different from the first shaping die.

18. The method according to claim 11, which further comprises using a 2-part or multi-part shaping die to produce the polygon geometry.

19. The method according to claim 11, wherein at least one tool is inserted into the base body and/or applied to the outer circumference of the base body during the reshaping method.

20. The method according to claim 19, wherein by means of the at least one tool, holding, indexing, perforating, filling, stamping and/or shaping is applied to the base body.

21. The method according to claim 10, which further comprises producing the polygon geometry starting from a cylindrical base body by means of rolling.

22. The method according to claim 10, which further comprises producing a further opening for receiving the primer cap before, during or after the polygon geometry is produced in the case base.

23. The method according to claim 10, wherein the polygon geometry has a 2n-fold rotational symmetry in relation to an axis of rotation, wherein n is a number≥3.

24. A method for producing a base part for a cartridge case having a case base for receiving a primer cap, the method comprises the following steps of:

supplying a cylindrical base body for producing the base part; and producing a circumferential extractor recess on an outer circumference of the cylindrical base body in a form of a polygon geometry forming a closed traverse in cross section.

25. The method according to claim 24, wherein the polygon geometry starting from the cylindrical base body is produced by a reshaping method and/or a machining method.

26. The method according to claim 25, which further comprises stamping the polygon geometry into the outer circumference of the cylindrical base body.

27. The method according to claim 25, which further comprises producing the polygon geometry by means of a plurality of shaping steps.

28. The method according to claim 27, wherein:

in a first shaping step, stamping a first polygon geometry into the outer circumference of the cylindrical base body; and in a second shaping step, stamping a second polygon geometry sectionally overlaying the first polygon geometry into the first polygon geometry.

29. The method according to claim 28, wherein first edges produced in the first shaping step are at least partially over-stamped in the second shaping step.

30. The method according to claim 28, wherein the cylindrical base body can be rotated axially by a predetermined angle relative to a shaping die following the first shaping step and before the second shaping step.

31. The method according to claim 28, which further comprises producing the first polygon geometry by means of a first shaping die and the second polygon geometry by means of a second shaping die which is different from the first shaping die.

32. The method according to claim 25, which further comprises using a 2-part or multi-part shaping die to produce the polygon geometry.

33. The method according to claim 25, wherein at least one tool is inserted into the cylindrical base body and/or applied to the outer circumference of the cylindrical base body during the reshaping method.

34. The method according to claim 33, wherein by means of the at least one tool, holding, indexing, perforating, filling, stamping and/or shaping is applied to the cylindrical base body.

35. The method according to claim 24, which further comprises producing the polygon geometry starting from the cylindrical base body by rolling.

36. The method according to claim 24, which further comprises producing a further opening for receiving the primer cap before, during or after the polygon geometry is produced in the case base.

37. The method according to claim 24, wherein the polygon geometry has a 2n-fold rotational symmetry in relation to an axis of rotation, wherein n is a number≥3.

38. A method for producing a cartridge case having a cylindrical case with a case opening formed therein for receiving a propellant charge and a projectile, and also a base part opposite the case opening having a case bottom for receiving a primer cap, which comprises the following steps of:

supplying the base part produced according to claim 24; and preforming the cylindrical case at the base part by means of extrusion.

39. The method according to claim 38, wherein the preforming takes place by means of extrusion and deep-drawing.

40. The method according to claim 38, wherein prior to the preforming of the cylindrical case, at least one tool is inserted into the base part and/or applied to the outer circumference of the base part.

41. The method according to claim 40, wherein by means of the at least one tool, holding, indexing, perforating, filling, stamping and/or forming is applied to the base part and/or the cylindrical case.

42. A method for producing a cartridge case having a cylindrical case with a case opening formed therein for receiving a propellant charge and a projectile, and also a base part opposite the case opening with a case base for receiving a primer cap, which comprises the following steps of:

supplying the base part produced according to claim 24;

supplying the cylindrical case; and connecting the base part to the cylindrical case by means of a joining method.

43. The method according to claim 42, which further comprises producing the base body and/or the cylindrical case from a non-ferrous metal or steel.

44. The method according to claim 43, which further comprises selecting the non-ferrous metal from the group consisting of brass, aluminum and aluminum alloy.

* * * * *